US011009274B2

(12) United States Patent
Takeda

(10) Patent No.: US 11,009,274 B2
(45) Date of Patent: May 18, 2021

(54) ACCUMULATOR, AND REFRIGERATION CYCLE

(71) Applicant: DENSO CORPORATION, Kariya (JP)

(72) Inventor: Yukihiko Takeda, Kariya (JP)

(73) Assignee: DENSO CORPORATION, Kariya (JP)

( * ) Notice: Subject to any disclaimer, the term of this patent is extended or adjusted under 35 U.S.C. 154(b) by 107 days.

(21) Appl. No.: 16/192,055

(22) Filed: Nov. 15, 2018

(65) Prior Publication Data

US 2019/0086131 A1 Mar. 21, 2019

Related U.S. Application Data

(63) Continuation of application No. PCT/JP2017/016319, filed on Apr. 25, 2017.

(30) Foreign Application Priority Data

May 19, 2016 (JP) ..... JP2016-100779

(51) Int. Cl.
*F25B 43/00* (2006.01)
*F25B 43/02* (2006.01)

(52) U.S. Cl.
CPC ..... *F25B 43/006* (2013.01); *F25B 43/00* (2013.01); *F25B 43/003* (2013.01); *F25B 43/02* (2013.01)

(58) Field of Classification Search
CPC ..... F25B 43/02; F25B 43/006; F25B 43/003
See application file for complete search history.

(56) References Cited

U.S. PATENT DOCUMENTS 4,768,355 A * 9/1988 Breuhan ..... F25B 43/006 261/DIG. 6
2014/0331713 A1 11/2014 Takeda et al.
2015/0231549 A1* 8/2015 Yamasaki ..... F25B 43/006 96/108
2017/0016658 A1* 1/2017 Hosokawa ..... F25B 43/006

FOREIGN PATENT DOCUMENTS

CN 103712385 A 4/2014
CN 104603555 A 5/2015
JP 2008164272 A 7/2008
JP 2013113508 A 6/2013
JP 2014052139 A 3/2014

* cited by examiner

*Primary Examiner* — Elizabeth J Martin
(74) *Attorney, Agent, or Firm* — Harness, Dickey & Pierce, P.L.C.

(57) ABSTRACT

An accumulator includes a tank, a desiccant, a suction pipe. The tank is configured to separate a refrigerant flowing therein into a gas-phase refrigerant and a liquid-phase refrigerant, store the liquid-phase refrigerant in the tank, and discharge the gas-phase refrigerant toward a suction side of a compressor. The desiccant is accommodated in a container and removing moisture in the refrigerant. The suction pipe is provided inside the tank and having a suction port through which the gas-phase refrigerant is sucked into the suction pipe. The desiccant is provided inside the suction pipe. According to this accumulator, a bumping due to the desiccant and an increase in size of the tank can be suppressed.

5 Claims, 5 Drawing Sheets

ACCUMULATOR, AND REFRIGERATION CYCLE

CROSS REFERENCE TO RELATED APPLICATION

The present application is a continuation application of International Patent Application No. PCT/JP2017/016319 filed on Apr. 25, 2017, which designated the United States and claims the benefit of priority from Japanese Patent Application No. 2016-100779 filed on May 19, 2016. The entire disclosures of all of the above applications are incorporated herein by reference.

TECHNICAL FIELD

The present disclosure relates to an accumulator and a refrigeration cycle.

BACKGROUND ART

An accumulator that includes a desiccant and is used in a refrigeration cycle is known.

SUMMARY

An accumulator according to a first aspect includes a tank, a desiccant, and a suction pipe. The tank is configured to separate a refrigerant flowing therein into a gas-phase refrigerant and a liquid-phase refrigerant, store the liquid-phase refrigerant in the tank, and discharge the gas-phase refrigerant toward a suction side of a compressor. The desiccant is accommodated in a container and removes moisture in the refrigerant The suction pipe is provided inside the tank and has a suction port through which the gas-phase refrigerant is sucked into the suction pipe. The desiccant is located inside the suction pipe.

EMBODIMENTS

Figure 1:
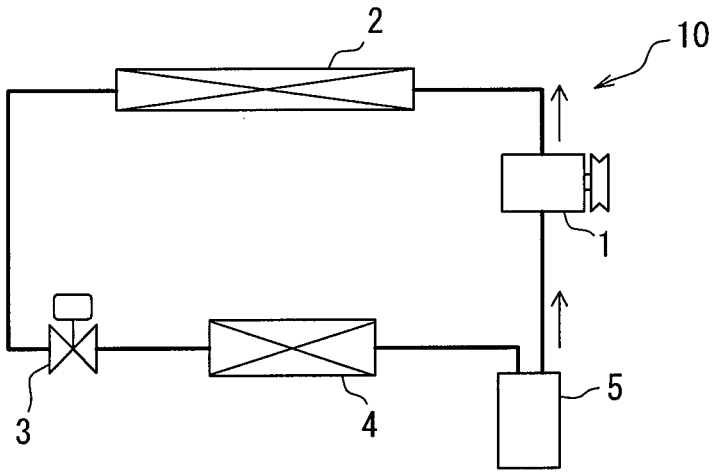
FIG. 1 is a diagram illustrating a refrigeration cycle including an accumulator according to at least one embodiment of the present disclosure.

Hereinafter, embodiments for implementing the present disclosure will be described referring to drawings. In each embodiment, portions corresponding to the elements described in the preceding embodiments are denoted by the same reference numerals, and redundant explanation may be omitted. In each of the embodiments, when only a part of the configuration is described, the other parts of the configuration can be applied to the other embodiments described above. It may be possible not only to combine parts the combination of which is explicitly described in an embodiment, but also to combine parts of respective embodiments the combination of which is not explicitly described if any obstacle does not especially occur in combining the parts of the respective embodiments.

First Embodiment

An accumulator of the present disclosure is configured to be applied to a refrigeration cycle for a vehicle or to a stationary refrigeration cycle. For example, the refrigeration cycle can be used for conditioning air of a target space such as a vehicle compartment, a room, and a test room. A refrigeration cycle 10 for air conditioning will be described below.

As shown in FIG. 1, the refrigeration cycle 10 includes at least a compressor 1, a condenser 2, a decompression valve 3, an evaporator 4, and the accumulator 5, and each component is connected with each other through pipes to form a annular shape. The compressor 1 is a refrigerant driving device that is driven by a driving source such as an engine and a motor to suck and discharge a refrigerant.

A gas-phase refrigerant discharged from the compressor 1 flows into the condenser 2 and is condensed by being cooled by a heat exchange with an outside air. The condenser 2 release heat of the refrigerant to outside and is an example of a heat dissipation heat exchanger. The decompression valve 3 decompresses the liquid-phase refrigerant condensed in the condenser 2, and thereby the refrigerant becomes a misty gas-liquid two phase refrigerant. The decompression valve 3 may be a fixed throttle such as an orifice and a nozzle, or a variable throttle configured to change an opening degree of the passage.

The refrigerant decompressed by the decompression valve 3 absorbs heat from the air blown by the air-conditioning blower and evaporates in the evaporator 4. The evaporator 4 is located in a casing of the air-conditioning device, and is an example of a cooling heat exchanger that allows the refrigerant to absorb heat from outside. The temperature of the air cooled by the evaporator 4 is adjusted to be a target temperature, and the air is blown toward the air-conditioning target space. The accumulator 5 separates the refrigerant flowing out of the evaporator 4 into a gas-phase refrigerant and a liquid-phase refrigerant. The accumulator 5 allows to the gas-phase refrigerant separated from the liquid-phase refrigerant to return to the compressor 1. The accumulator 5 allows an oil mixed in the liquid-phase refrigerant stored in the bottom portion of the tank 50 to return to the compressor 1.

Figure 2:
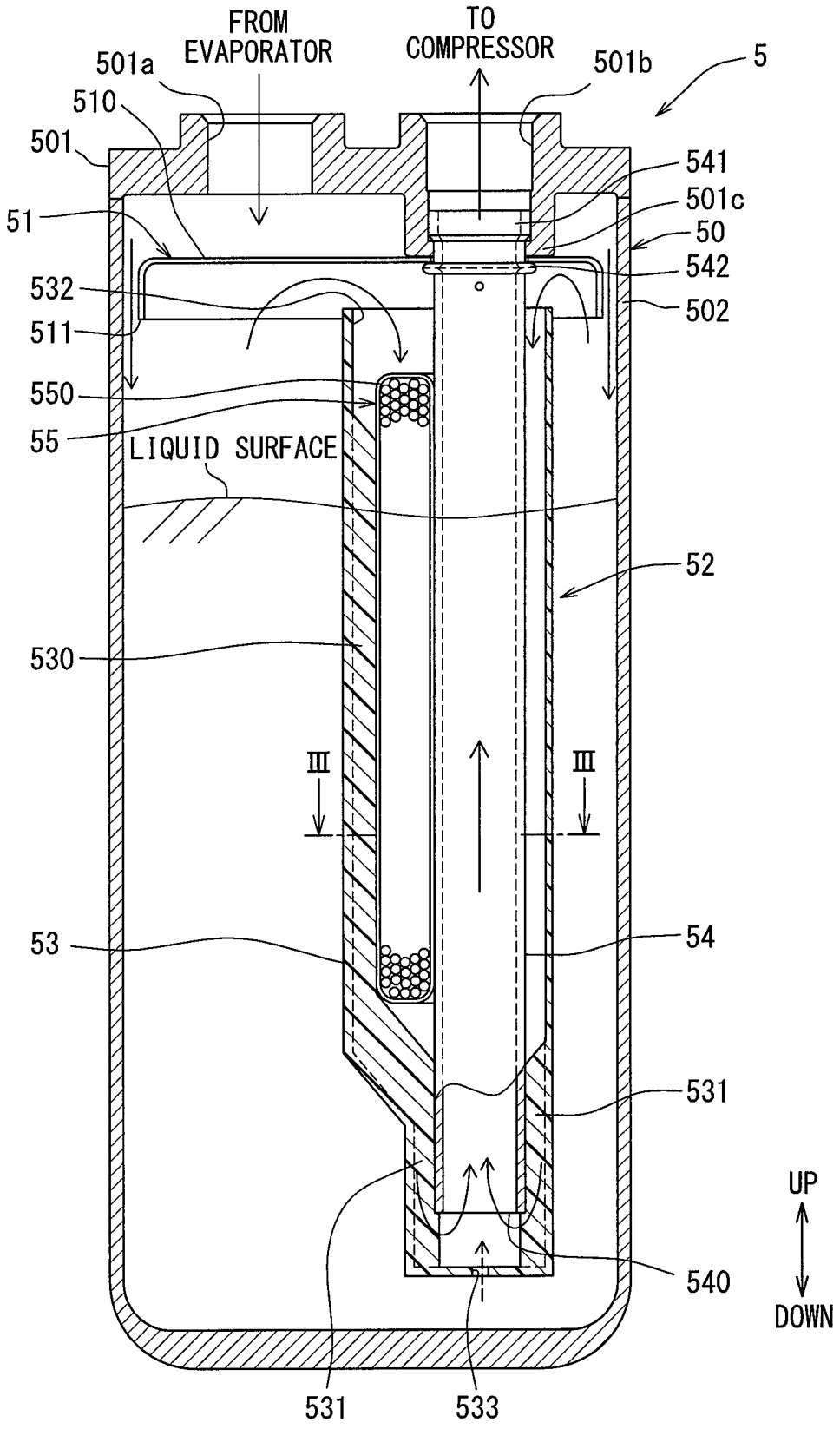
FIG. 2 is a cross-sectional view illustrating the accumulator according to at least one embodiment.

FIG. 2 is a cross-sectional view illustrating the accumulator 5. As shown in FIG. 2, the accumulator 5 includes a tank 50 that separates the refrigerant flowing therein into a gas-phase refrigerant and a liquid-phase refrigerant, stores the liquid-phase refrigerant, and allows the gas-phase refrigerant to flow out toward a suction side of the compressor. Arrows illustrated in FIGS. 2, 3 indicate directions in a condition where the accumulator 5 is in the refrigeration cycle 10.

The tank 50 includes a tank body portion 502 defining therein a space for storing the liquid-phase refrigerant, and a lid portion 501 for closing an upper end opening of the tank body portion 502. The tank body portion 502 and the lid portion 501 are made of metal. An upper end of the tank body portion 502 and the lid portion 501 are joined with each other by welding.

The tank body portion 502 has a bottomed cylindrical shape whose upper end is open, and accommodates a suction pipe 52 and a desiccant 55. The tank body portion 502 stores therein the separated liquid-phase refrigerant and a lubricating oil mixed in the liquid-phase refrigerant. The suction pipe 52 includes an outer pipe 53 having a suction port 532 from which the gas-phase refrigerant is sucked and an inner pipe 54 located inside the outer pipe 53.

The lid portion 501 has a flat circular cylindrical shape whose outer diameter is the same as that of the tank body portion 502. The lid portion 501 includes a refrigerant inlet 501*a* and a refrigerant outlet 501*b* which extend through the lid portion 501 in an up-down direction and have a circular shape. The refrigerant inlet 501*a* is connected to the evaporator 4 through a pipe. The refrigerant that has exchanged heat in the evaporator 4 flows into the tank body portion 502 through the pipe and the refrigerant inlet 501*a*. The refrigerant outlet 501*b* is connected to the compressor 1 through the pipe. The separated gas-phase refrigerant in the tank body portion 502 is sucked into the compressor 1 through the refrigerant outlet 501*b* and the pipe.

The refrigerant flowing downward in a vertical direction into the tank 50 through the refrigerant inlet 501*a* hits an umbrella-shaped member 51. The umbrella-shaped member 51 includes a lateral wall portion 511, and an upper wall portion 510. The lateral wall portion 511 has a circular cylindrical shape extending in the up-down direction, and the upper wall portion 510 closes an upper end side of the lateral wall portion 511. A lower end side of the lateral wall portion 511 is open. The umbrella-shaped member 51 is arranged in the tank 50 such that the upper wall portion 510 is located under the refrigerant inlet 501*a*. The lateral wall portion 511 extending from an outer circumference of the upper wall portion 510 is close to an inner wall surface of the tank body portion 502. The umbrella-shaped member 51 is made of metal.

The inner pipe 54 of the suction pipe 52 that is a double pipe is fixed, by press-fitting, to a lower end portion 501*c* protruding downward in a state where an upper end portion 541 is engaged with an inside of the refrigerant outlet 501*b*. A part of the umbrella-shaped member 51 facing the refrigerant inlet 501*a* protrudes upward, and an opening is formed at a part of the umbrella-shaped member 51 facing the refrigerant outlet 501*b*. A peripheral portion defining the opening portion of the umbrella-shaped member 51 is located at a position corresponding to the refrigerant outlet 501*b*. The peripheral portion is interposed between the lower end portion 501*c* of the lid portion 501 and a large diameter portion 542 of the inner pipe 54 press-fitted to the lower end portion 501*c* of the lid portion 501. That is, the inner pipe 54 is fixed to a lower part of the lid portion 501. The large diameter portion 542 is a part lower than an upper end of the inner pipe 54 by a predetermined length and is larger in outer diameter than the upper end portion 541. The large diameter portion 542 is can be formed by pressing to increase the diameter in a manufacturing process of the inner pipe 54. When the inner pipe 54 is made of resin, the large diameter portion 542 can be formed by resin molding with a die.

The refrigerant introduced from the refrigerant inlet 501*a* hits against the umbrella-shaped member 51, and then the accumulator 5 separates the refrigerant into the liquid-phase refrigerant and the gas-phase refrigerant. The refrigerant hit against the upper wall portion 510 of the umbrella-shaped member 51 spreads horizontally in the tank 50 and is guided to a horizontally outside of the outer circumference of the upper wall portion 510 of the umbrella-shaped member 51. The liquid-phase refrigerant falls along the lateral wall portion 511 through the horizontally outer side of the umbrella-shaped member 51, the liquid-phase refrigerant flows along the inner wall of the tank body portion 502, and then the liquid-phase refrigerant is stored in the lower part of the tank body portion 502. The gas-phase refrigerant under the umbrella-shaped member 51 is sucked from the suction port 532 located at the upper end of the outer pipe 53 into the suction pipe 52.

The inner pipe 54 and the outer pipe 53 are linear pipes whose axes extend linearly, are accommodated in the tank body portion 502, and extend along the vertical direction. The inner pipe 54 and the outer pipe 53 are coaxial. The inner pipe 54 is made of a metal material containing aluminum, for example. The outer pipe 53 is made of a material that is higher in heat insulation property than the inner pipe 54. The outer pipe 53 is made of a resin material superior in heat insulation property, for example.

Figure 3:
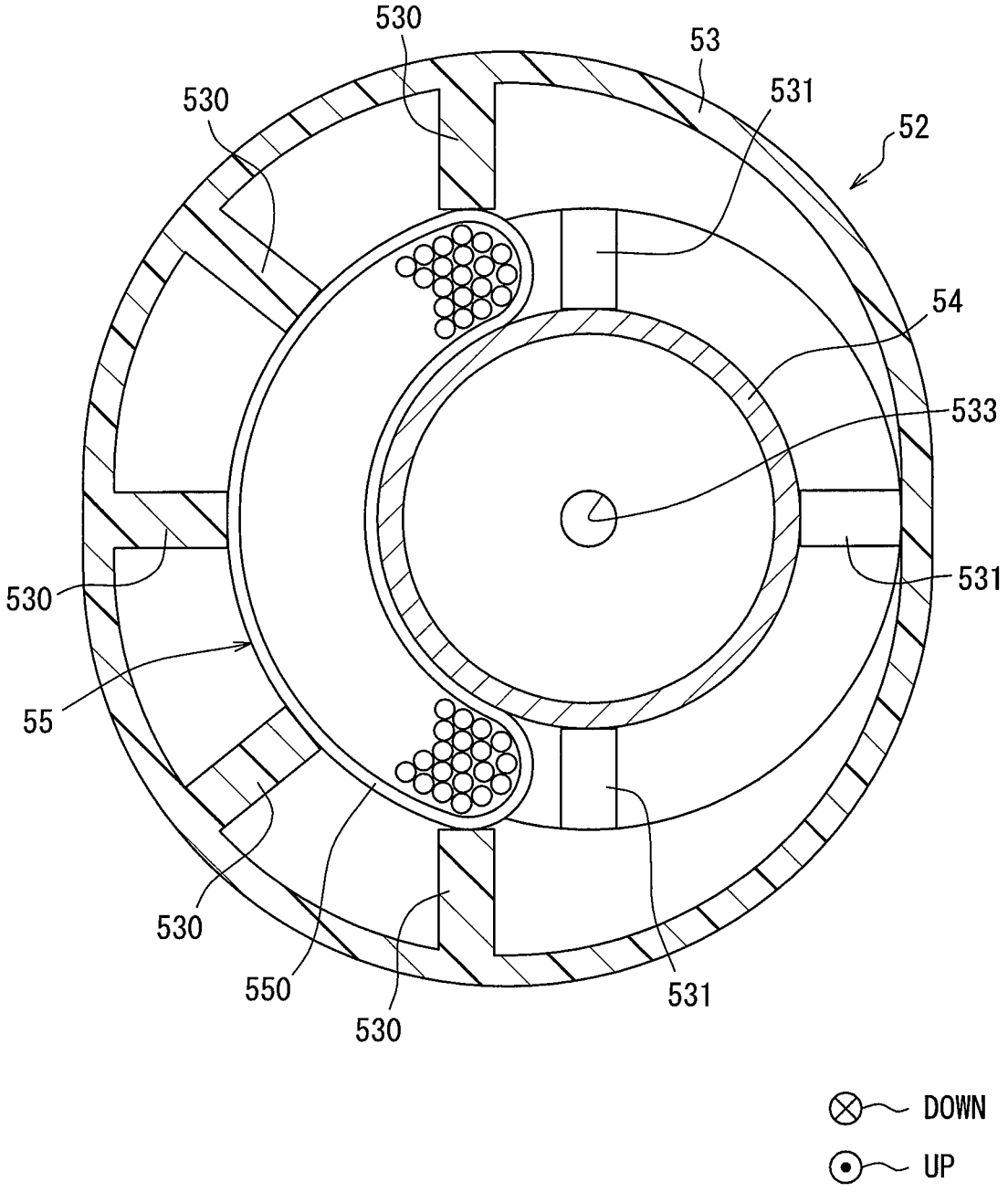
FIG. 3 is a cross-sectional view taken along a line III-III in FIG. 2.
Figure 4:
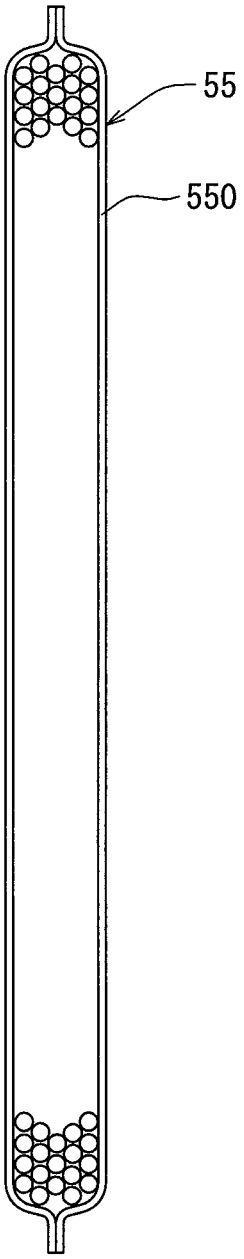
FIG. 4 is a diagram illustrating a desiccant of the present disclosure.

As shown in FIGS. 2, 3, the outer pipe 53 is fixed to the inner pipe 54. Multiple protrusions 531 protruding inward from some parts of the inner wall surface are provided in the lower part of the outer pipe 53. Since each inner part of the protrusions 531 are press-fitted to the lower part of the inner pipe 54, the outer pipe 53 is joined and fixed to the inner pipe 54 in a condition where the protrusions 531 support the outer peripheral surface of the lower part of the inner pipe 54.

The outer pipe 53 is arranged, such that the upper end opening portion defining the suction port 532 for the gas-phase refrigerant is spaced from the upper wall portion 510 of the umbrella-shaped member 51 and located above the lower end of the umbrella-shaped member 51. An oil return hole 533 extending through the lower end part of the outer pipe 53 is formed in the outer pipe 53. Accordingly, the lower end portion of the outer pipe 53 is closed except for the oil return hole 533. The oil return hole 533 is at a position facing a lower end opening portion 540 of the inner pipe 54. The oil return hole 533 is an oil return passage through which the lubricating oil stored in the lower part of the tank body portion 502 is sucked by using the gas-phase refrigerant flowing into the inner pipe 54, and the lubricating oil flows through the inner pipe 54 together with the gas-phase refrigerant and flows out of the accumulator 5. The amount of the oil circulating in the refrigeration cycle 10 can be secured by the oil return hole 533.

As shown in FIGS. 2 and 3, the outer pipe 53 includes multiple support portions 530. The support portions protrude inward from the inner surface of the outer pipe 53 and are in contact with the most part of the desiccant 55 in the up-down direction. The support portions 530 are integrally molded with the outer pipe 53 and made of resin. The support portions 530 are ribs whose cross-sections are rectangular. The support portions 530 are arranged inside the outer pipe 53 at regular intervals in the circumferential direction. The desiccant 55 are interposed between the support portions 530 and the outer surface of the inner pipe 54. The desiccant 55 is pushed to the inner pipe 54 by the support portions 530 arranged in the circumferential direction. Accordingly, a large part of the desiccant 55 in the circumferential direction is in contact with the outer surface of the inner pipe 54, and a contact area for heat transfer can be secured. The desiccant 55 are supported by the support portions 530 and is in contact with the outer pipe 54 and the outer pipe 53. The desiccant 55 is interposed between the support portions 530 and the inner pipe 54. The support portions 530 support the desiccant 55 such that the desiccant is not displaced in the radial direction.

The lower end surface of the support portion 530 is inclined with respect to the lateral surface of the inner pipe 54 to be closer to the lateral surface of the inner pipe 54. The lower end surface extends downward and inward in the radial direction of the inner pipe 54. According to this configuration, the inclined lower end surface supports the bottom portion of the desiccant 55 to limit a downward motion of the desiccant 55. The support portion 530 may include a step portion for supporting the bottom portion of the desiccant 55. A length of a lower part of the step portion is larger than that of an upper part of the step portion. According to this configuration, the longer lower part supports the bottom portion of the desiccant 55 to limit a downward motion of the desiccant 55.

The upper end surface of the support portion 530 is inclined away from the lateral surface of the inner pipe 54 such that the upper end surface extends upward and outward in the radial direction of the inner pipe 54. According to this configuration, when the desiccant 55 is set between the outer pipe 53 and the inner pipe 54, the desiccant can be inserted smoothly through the inclined upper end surface of the support portion 530 without stuck of the bottom portion of the desiccant 55. The upper end of the desiccant 55 is located below the upper end opening of the outer pipe 53, and the lower end of the desiccant 55 is located above the lower end opening portion 540 of the inner pipe 54.

In manufacturing the accumulator 5, the upper end portion 541 of the inner pipe 54 is inserted into the lower part of the lid portion 501 through the umbrella-shaped member 51, and then the upper end portion 541 is expanded and fixed to the lid portion 501. Accordingly, the lid portion 501 and the suction pipe 52 are integrated with each other. The desiccant 55 is placed between the support portions 530 and the inner pipe 54, and then the outer pipe 53 is press-fitted to the integrated component. Next, the lid portion 501 is joined to the upper end of the tank body portion 502 by welding in a condition where the suction pipe 52 is located inside the tank body portion 502. According to this, the accumulator 5 including the desiccant 55, the suction pipe 52, and the umbrella-shaped member 51 is manufactured.

The desiccant 55 removes moisture from the refrigerant in the refrigeration cycle 10. The desiccant 55 is a particle such as a zeolite and accommodated in a container 550 having a pouch shape. The container 550 is made of fabric such as ferrite, is flexible, and serves as a filter. Since the shape of the container 550 is changed easily, the shape can be easily changed to a shape corresponding to the outer peripheral shape of the inner pipe 54 when the container 550 is placed between the support portions 530 and the inner pipe 54.

In the accumulator 5, the refrigerant flowing out of the evaporator 4 flows into the tank body portion 502 through the refrigerant inlet 501*a*. The refrigerant flowing into the tank body portion 502 is guided by the umbrella-shaped member 51 toward the inner wall of the tank body portion 502 and thus separated into the gas-phase refrigerant and the liquid-phase refrigerant. The liquid-phase refrigerant separated from the gas-phase refrigerant gathers in the lower part of the tank body portion 502. The gas-phase refrigerant passes through the inside of the inner pipe 54 after passing through the desiccant 55 inside the outer pipe 53. Then the gas-phase refrigerant flows toward the compressor 1 through the refrigerant outlet 501*b*. When the gas-phase refrigerant flows out of the outer pipe 53 into the inner pipe 54, the lubricating oil stored in the lower part of the tank body portion 502 is sucked through the oil return hole 533, and thus the lubricating oil flows with the gas-phase refrigerant toward the compressor 1 through the inner pipe 54 and the refrigerant outlet 501*b*.

Next, the effects provided by the accumulator 5 of the first embodiment will be described. In an accumulator of comparative example, a part of the desiccant is located above the highest part of the liquid level of the liquid-phase refrigerant in the tank while the compressor stops, and the desiccant is located at a position where the liquid-phase refrigerant does not fall. Although the accumulator of the comparative example is capable of reducing the level of the noise, bumping may occur in a part of the desiccant soaked in the liquid-phase refrigerant and generate the noise. If the desiccant is located in the upper part of the tank so as not to be soaked in the liquid-phase refrigerant, a space that is not allowed for storing the liquid-phase refrigerant may increase.

The inventor investigated the cause of bumping in the desiccant in the tank at the start of the refrigeration cycle. As a result, the inventor found that the temperature decrease delays with respect to the pressure drop in the tank, resulting that the liquid-phase refrigerant is overheated, and thus the bumping occurs. Therefore, in order to suppress bumping in the desiccant, it is useful to quickly discharge the liquid-phase refrigerant from the desiccant at the start of the refrigeration cycle to quickly lower the temperature around the desiccant.

The accumulator 5 of the present disclosure includes: the tank 50 separates the refrigerant flowing therein into the gas-phase refrigerant and the liquid-phase refrigerant, stores the liquid-phase refrigerant therein, and causes the gas-phase refrigerant to flow toward the suction side of the compressor 1; the desiccant 55; and the suction pipe 52 through which the gas-phase refrigerant is sucked. The desiccant 55 is located inside the suction pipe 52.

According to this accumulator 5, since the liquid-phase refrigerant in the suction pipe 52 is quickly discharged from the accumulator 5 after the start of the compressor 1, the liquid-phase refrigerant stored in the suction pipe 52 while the compressor 1 stops is discharged from the accumulator 5. Therefore, the desiccant 55 in the suction pipe 52 is exposed to the gas. That is, when the compressor is activated, the desiccant 55 quickly gets out of a condition where the desiccant 55 contacts with the liquid-phase refrigerant. In this manner, due to the activation of the compressor 1, the pressure and the temperature in the suction pipe 52 decreases due to the discharge of the liquid-phase refrigerant, and the desiccant 55 can be cooled quickly even when the desiccant 55 has a large heat capacity. Accordingly, since the desiccant 55 does not soak in the liquid-phase refrigerant at the activation of the compressor 1, a bumping can be avoided.

Further, since the liquid-phase refrigerant can be limited from overheating even if a small amount of the liquid-phase refrigerant remains in the desiccant 55, a bumping can be suppressed. Since the desiccant 55 is provided in the suction pipe 52 that serves as a liquid reservoir space in which the refrigerant is stored when the compressor 1 stops, a space that does not serve as a liquid reservoir space in the tank 50 can be limited. Accordingly, the accumulator 5 is free from a dilemma between reducing a volume of the desiccant soaked in the liquid-phase refrigerant for reducing the noise due to bumping and limiting the increase of the volume of the tank. That is, according to the accumulator 5, the bumping caused by the desiccant 55 and the increase in size of the tank 50 can be suppressed.

The suction pipe 52 includes the outer pipe 53 having the suction port 532 and the inner pipe 54 located inside the outer pipe 53. According to this configuration, the desiccant can be provided in the inner space of the inner pipe 54 or in the inner space defined between the inner surface of the outer pipe 53 and the outer surface of the inner pipe 54. In both cases, the desiccant 55 that may contact with the liquid-phase refrigerant while the compressor 1 stops can be quickly exposed to the gas-phase refrigerant by the suction force of the compressor when the compressor 1 is activated. The accumulator 5 limits the bumping regardless of the position of the desiccant 55 in the suction pipe 52.

Further, the desiccant 55 is disposed inside the outer tube 53 and outside the inner tube 54. According to this configuration, since the desiccant 55 is sandwiched by the inner surface of the outer pipe 53 and the outer surface of the inner pipe 54, it is possible to provide a structure that easily secures the holding power and the assembling property of the desiccant 55.

The inner pipe 54 is made of metal material having a heat conductivity. The desiccant 55 is located inside the suction pipe 52 and is in contact with the inner pipe 54. According to this configuration, as the liquid-phase refrigerant in the suction pipe 52 is discharged at the time of start-up of the compressor 1 and the pressure decreases, the temperature around the desiccant decreases and the inner pipe 54 is cooled. By cooling the inner pipe 54, the temperature of the desiccant 55 can be rapidly lowered. As a result, since the temperature decrease of the desiccant 55 does not greatly delay with respect to the pressure decrease, the refrigerant attached to the desiccant 55 does not become overheated. Therefore, even if the liquid-phase refrigerant slightly remains in the desiccant 55, it is possible to suppress the occurrence of bumping.

The inner pipe 54 is made of metal material having a heat conductivity. The outer pipe 53 is made of a material that is higher in heat insulation property than the inner pipe 54. The desiccant 55 is in contact with both the inner pipe 54 and the outer pipe 53. According to this configuration, since the desiccant 55 is in contact with the inner pipe 54, the above-described effects can be achieved. In addition, since the desiccant 55 is in contact with the outer pipe 53, heat transfer from the liquid-phase refrigerant in contact with the outer surface of the outer pipe 53 to the desiccant 55 can be limited. Accordingly, since the heat transfer from the liquid-phase refrigerant to the desiccant 55 is limited, and the heat transfer from the desiccant 55 to the inner pipe 54, the temperature of the desiccant 55 can be decreased quickly.

The outer pipe 53 includes support portions 530 protruding inward from the inner surface. The desiccant 55 is supported by the support portions 530 and is in contact with the inner pipe 54. According to this configuration, since the desiccant 55 is pushed to the inner pipe 54 by the support portions 530, the contact area of the desiccant 55 and the outer surface of the inner pipe 54 can be increased to securely contact with each other. Since the desiccant 55 is in contact with the support portions 530, the contact area of the desiccant 55 and the outer pipe 53 can be decreased. Accordingly, since the heat transfer from the liquid-phase refrigerant to the desiccant 55 is limited, and the heat transfer from the desiccant 55 to the inner pipe 54, the temperature of the desiccant 55 can be decreased quickly for sure.

The refrigeration cycle 10 includes the accumulator 5, the compressor 1 configured to circulate the refrigerant in the circuit, the condenser 2 configured to dissipate heat of the refrigerant discharged from the compressor 1, the decompression valve 3 configured to decompress the refrigerant flowing out of the condenser 2, and the evaporator 4 configured to absorb heat using the refrigerant decompressed by the decompression valve 3. Since the refrigeration cycle 10 includes the accumulator 5, the refrigeration cycle in the suction pipe 52 can be discharged from the accumulator 5 quickly after the compressor 1 is activated, and the desiccant 55 in the suction pipe 52 can be exposed to the gas. Accordingly, since the pressure and the temperature in the suction pipe 52 decrease, the desiccant 55 can be quickly cooled and the bumping in the desiccant 55 can be limited even if the desiccant 55 has a large heat capacity. Since the desiccant 55 is provided inside the suction pipe 52, the suction pipe 52 can be used as the liquid reservoir space while the compressor 1 stops, and accordingly a space that does not serve as a liquid reservoir space can be limited. By using the accumulator 5 having the above-described effects, bumping in the desiccant 55 and increasing the size of the tank 50 of the accumulator 5 in the refrigeration cycle 10 can be limited.

Second Embodiment

Figure 5:
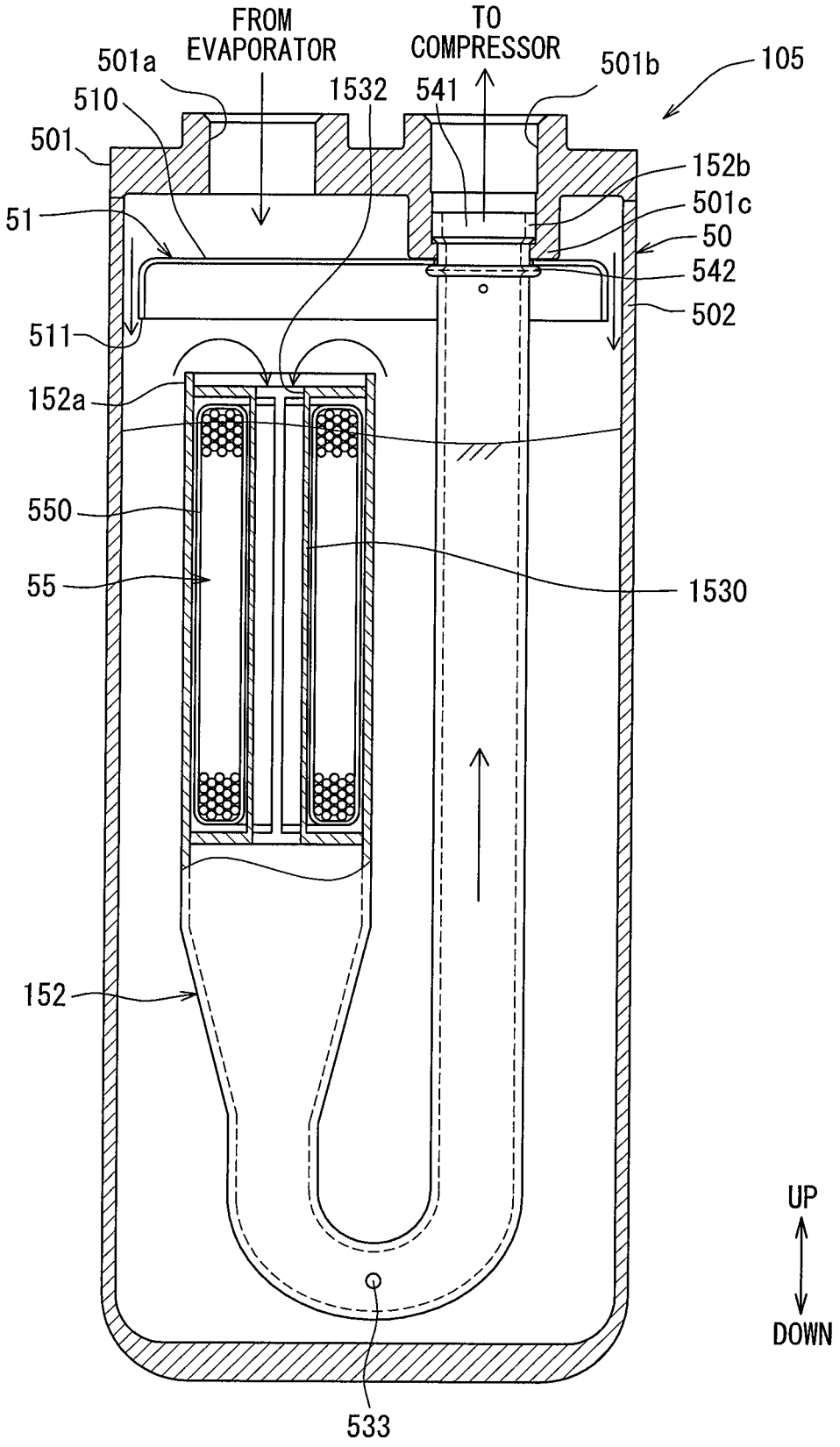
FIG. 5 is a cross-sectional view illustrating an accumulator according to at least one embodiment.

The second embodiment will be described with reference to FIG. 5. In the second embodiment, constituent parts denoted by the same reference numerals as those in the drawings according to the first embodiment and configurations not described are the same as those of the first embodiment, and the same effects are exhibited. In the second embodiment, portions different from those in the first embodiment will be described.

An accumulator 105 of the second embodiment has a suction pipe different from the accumulator 5 of the first embodiment. As shown in FIG. 5, the suction pipe of the accumulator 105 is a single pipe 152 having one end portion 152*a* defining a suction port 1532 and the other end portion 152*b* connected to the refrigerant outlet 501*b* through which the gas-phase refrigerant flows toward the suction side of the compressor 1. The other end portion 152*b* corresponds to the upper end portion 541 of the first embodiment. The single pipe 152 has a shape bent in U-shape from the one end portion 152*a* and the other end portion 152*b*. The one end portion 152*a* may be a first end portion, and the other end portion 152*b* may be a second end portion.

The desiccant 55 is supported by a holding member 1530 provided in the vicinity of the one end portion 152*a* in the single pipe 152. The desiccant 55 is provided in the single pipe 152 to form a C-shape or a donut shape. A cross-sectional area of a part of the single pipe 152 in which the desiccant 55 is provided is larger than the remaining parts of the single pipe 152.

The holding member 1530 includes an opening portion that communicates with the suction port 1532 or corresponds to the suction port 1532. The gas-phase refrigerant sucked into the single pipe 152 through the suction port 1532 flows downward through the desiccant 55 in the single pipe 152, and then the gas-phase refrigerant is discharged toward the compressor 1. The flow of the refrigerant in the accumulator 105 generated at the time of the activation of the compressor 1 is the same as the first embodiment. Accordingly, also in the accumulator 105, since the pressure and the temperature in the single pipe due to the discharge of the liquid-phase refrigerant, the desiccant 55 can be cooled quickly. Accordingly, since the desiccant 55 in the accumulator 105 does not soak in the liquid-phase refrigerant at the activation of the compressor 1, a bumping can be avoided.

According to the second embodiment, the desiccant 55 is provided inside the single pipe 152. According to the accumulator 105, since the desiccant 55 can be inserted into the single pipe 152 from the one end portion 152*a* side, the desiccant 55 can be easily mounted in the single pipe 152.

The single pipe 152 includes the oil return hole 533 connecting an inside of the single pipe 152 and an outside of the single pipe 152. The desiccant 55 is provided inside the single pipe 152 and between the oil return hole 533 and the suction port 1532. According to this configuration, since the desiccant 55 is not provided in a position where the oil in the liquid-phase refrigerant stored in the bottom portion of the tank body portion 502 returns into the single pipe 152, the refrigerant in the desiccant 55 can be discharged easily. Further, since the desiccant 55 is not provided in the position where the oil returns into the single pipe 152, the oil is unlikely to adhere the desiccant 55, and accordingly the oil does not limit the flow of the refrigerant flowing out of the desiccant 55. Accordingly, the accumulator 105 is capable of cooling the desiccant 55 quickly.

The disclosure of this specification is not limited to the illustrated embodiment. The disclosure encompasses the illustrated embodiments and modifications by those skilled in the art based thereon. The present disclosure is not limited to combinations disclosed in the above-described embodiment but can be implemented in various modifications. The present disclosure can be implemented in various combinations. The disclosure may have additional parts that may be added to the embodiment. The disclosure encompasses omissions of parts and/or elements of the embodiments. The disclosure encompasses replacement or combination of parts and/or elements between one embodiment and another. The disclosed technical scope is not limited to the description of the embodiment.

The positions of the refrigerant inlet and the refrigerant outlet of the above-described embodiments are not limited to the upper portion of the tank 50. The refrigerant outlet may be located in the lower part of the tank 50 while the refrigerant inlet is located in the upper part of the tank 50. The refrigerant inlet and the refrigerant outlet may be formed to communicate with passages extending through the lateral walls of the tank 50.

The accumulators 5, 105 are not limited to being applied to the refrigeration cycle 10 described in the above embodiments. The accumulators 5, 105 may be applied to refrigerant cycles having components and circuit configurations different from those of the refrigeration cycle 10.

A filter for removing sludge contained in the oil may be provided in the oil return passage of the above embodiments.

The desiccant 55 of the first embodiment may be provided inside the inner pipe 54.

Although the present disclosure has been described in accordance with the embodiments, it is understood that the present disclosure is not limited to the embodiments and structures disclosed therein. To the contrary, the present disclosure is intended to cover various modification and equivalent arrangements. In addition, while the various elements are shown in various combinations and configurations, which are exemplary, other combinations and configurations, including more, less or only a single element, are also within the spirit and scope of the present disclosure.

What is claimed is:

1. An accumulator comprising:

a tank configured to separate a refrigerant flowing therein into a gas-phase refrigerant and a liquid-phase refrigerant, store the liquid-phase refrigerant in the tank, and discharge the gas-phase refrigerant toward a suction side of a compressor;

a desiccant accommodated in a container and removing moisture in the refrigerant; and a suction pipe provided inside the tank and having a suction port through which the gas-phase refrigerant is sucked into the suction pipe, wherein the container of the desiccant is provided inside the suction pipe, and the suction pipe includes an outer pipe having the suction port, and an inner pipe provided inside the outer pipe.

2. The accumulator according to claim 1, wherein the desiccant is provided inside the outer pipe and outside the inner pipe.

3. The accumulator according to claim 1, wherein the inner pipe is made of metal, and the desiccant is in contact with the inner pipe.

4. The accumulator according to claim 1, wherein the inner pipe is made of metal, the outer pipe is made of a material higher in heat insulation property than the inner pipe, and the desiccant is in contact with both the inner pipe and the outer pipe.

5. The accumulator according to claim 4, wherein the outer pipe includes a plurality of support portions protruding inward from an inner surface of the outer pipe, and the desiccant is in contact with the inner pipe in a condition where the plurality of support portions support the desiccant.

* * * * *